US005615636A

United States Patent [19]

Gustafson

[11] Patent Number: 5,615,636

[45] Date of Patent: Apr. 1, 1997

[54] PORTABLE SCOREBOARD

[76] Inventor: Carl E. Gustafson, 2370 Crestview Ave., Alliance, Ohio 44601

[21] Appl. No.: 298,943

[22] Filed: Aug. 31, 1994

[51] Int. Cl.[6] ..... A63B 71/06

[52] U.S. Cl. ..... 116/223

[58] Field of Search ..... 116/223, 224; 273/DIG. 26; 40/533, 536

[56] References Cited

U.S. PATENT DOCUMENTS

| | | | |
|---|---|---|---|
| 1,279,539 | 9/1918 | Haggerty . | |
| 1,709,041 | 10/1926 | Schutt | 40/536 |
| 2,280,682 | 4/1942 | Baker | 40/530 |
| 2,608,011 | 4/1947 | Hoeve | 40/102 |
| 2,832,172 | 4/1958 | Shelp | 40/533 X |
| 2,945,594 | 7/1960 | Parker | 211/46 |
| 3,246,411 | 4/1966 | Aafedt | 116/222 |
| 3,576,174 | 4/1971 | Topei . | |
| 5,329,874 | 7/1994 | Posey | 116/222 |

FOREIGN PATENT DOCUMENTS

| | | | |
|---|---|---|---|
| 291547 | 10/1967 | Australia | 116/223 |
| 1228154 | 4/1971 | United Kingdom | 40/536 |
| 2218339 | 11/1989 | United Kingdom | 273/DIG. 26 |

*Primary Examiner*—William A. Cuchlinski, Jr.
*Assistant Examiner*—Willie Morris Worth
*Attorney, Agent, or Firm*—Woodard, Emhardt, Naughton Moriarty & McNett

[57] ABSTRACT

A portable scoreboard which includes a mounting frame, at least one leg member having a first end detachably attached to the mounting frame, a plurality of cards having indicia and arranged in at least two stacks which are aligned in spaced relation along the length of the mounting frame, and a ring member threaded through a corresponding one of the fastening apertures in the cards. The cards hang from the rings so that the cards may be rotated around the mounting frame to permit alternate display of the indicia on the cards. In one specific embodiment, the mounting frame defines a plurality of holes aligned in spaced relation along a length of the mounting frame and one of the ring members is threaded through each of the holes. In another specific embodiment of the invention, the mounting frame is shaped into an inverted-U and a support member is attached to a second end of each of the leg members. The support member has an end configured to be driven into the ground. Alternatively, the support member is configured to support the scoreboard on an interior surface. In still another embodiment, there is provided a post-mountable portable scoreboard which includes a mounting frame, a horizontal support member attachable to a post, a pair of leg members having a first end detachably attachable to a vertical portion of the mounting frame and a second end attached to the horizontal support member, and a plurality of cards having indicia and arranged in at least two stacks aligned in spaced relation along the length of the mounting frame.

15 Claims, 8 Drawing Sheets

PORTABLE SCOREBOARD

FIELD OF THE INVENTION

The present invention broadly concerns devices for scoring sporting events or other games. More specifically, the invention concerns a portable scoreboard which breaks down into separate pieces for easy storage and transportation.

BACKGROUND OF THE INVENTION

In recent years there has been a great increase in the interest in recreational sports and activities. Various mechanical and electrical scoreboards have been developed and are available for indicating the score during sporting events. Most of these scoreboards are permanent fixtures in stadiums or playing fields. The increased interest in organized sports at community levels, as well as sports in more casual situations in neighborhood parks and community playing fields, has resulted in a need for portable scoreboards.

One portable scorekeeping device, U.S. Pat. No. 3,246,411 to Aafedt, utilizes dual-sided cards with means for attachment to a table. This device provides for easy viewing and score changing. However, it requires the presence of a table. Another reference, U.S. Pat. No. 1,709,041 to Schutt, teaches a football down marker with numbers suspended from a horizontal bar. The down marker is provided with a spiked element for sticking in the ground. The disclosed device is portable and the spiked element provides a means for temporarily attaching the down marker to the ground.

Other various mechanical and electrical scoring devices have been disclosed. However, these systems have proved unsatisfactory for use during organized sporting events in community playing fields. Such community parks typically have numerous playing fields which are used by teams at various playing levels. Typically, communities do not have the resources for providing each playing field with a costly, permanent scoring device. A need exists for portable scoring devices which provide visibility from a distance and provide for easy breakdown, packaging, storage and transportation.

There is currently no system that addresses each of these features in a single apparatus. The present invention addresses these needs and provides other benefits not previously found in portable scoring devices of the prior art.

SUMMARY OF THE INVENTION

In accordance with the present invention, a portable scoreboard is provided for sporting events, which includes a mounting frame, at least one leg member having a first end detachably attached to the mounting frame, a plurality of cards having indicia and arranged in at least two stacks and which are aligned in spaced relation along the length of the mounting frame, and a ring member threaded through a corresponding one of the fastening apertures in the cards. According to the present invention, the cards hang from the rings so that the cards may be rotated around the mounting frame to permit alternate display of the indicia on the cards.

In one specific embodiment, the mounting frame defines a plurality of holes aligned in spaced relation along a length of the mounting frame and one of the ring members is threaded through each of the holes. In another specific embodiment of the invention, the mounting frame is shaped into an inverted-U and a support member is attached to a second end of each of the leg members. The support member has an end configured to be driven into the ground. Alternatively, the support member may be configured to support the scoreboard on an interior surface.

In still another embodiment, there is provided a fence post mountable portable scoreboard which includes a mounting frame, a horizontal support member attachable to a post, a pair of leg members having a first end detachably attachable to a vertical portion of the mounting frame and a second end attached to the horizontal support member, and a plurality of cards having indicia and arranged in at least two stacks aligned in spaced relation along the length of the mounting frame.

One object of the invention is to provide an apparatus for indicating the score of a sporting event.

Another object of the invention is to provide a scorekeeping apparatus which is conveniently transportable.

One benefit of the apparatus of the present invention is that it may be adaptable for indoor or outdoor use. Another benefit of the present invention is that it may be inexpensively manufactured. Yet another benefit achieved by the invention resides in providing for an easily portable scoreboard device.

Other objects and further benefits of the present invention will become apparent to persons of ordinary skill in the art from the following written description and accompanying figures.

A BRIEF DESCRIPTION OF THE DRAWINGS

Figure 6A:
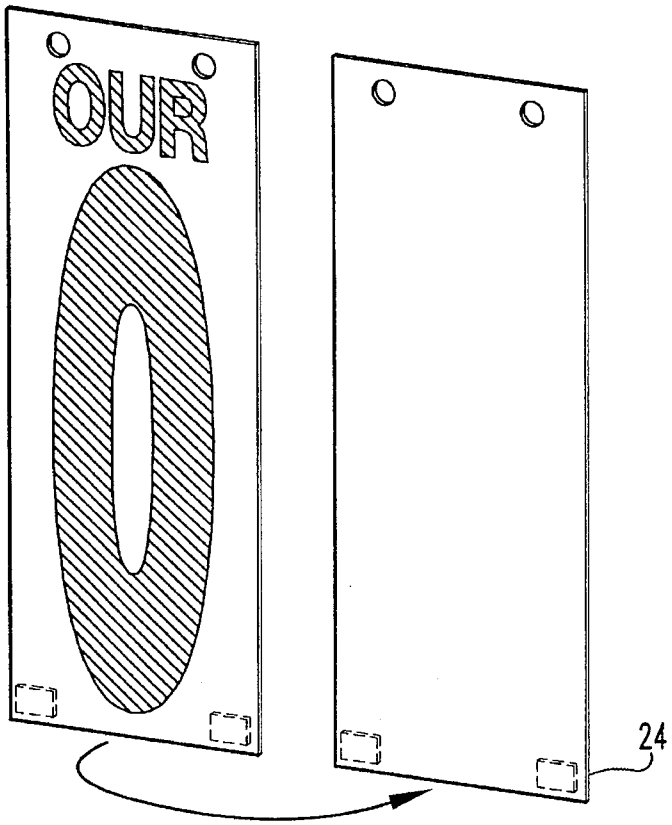

FIGS. 6(A) and (B) are front and back elevational views of the corresponding front and back sides of cards according to one embodiment.

Figure 7:
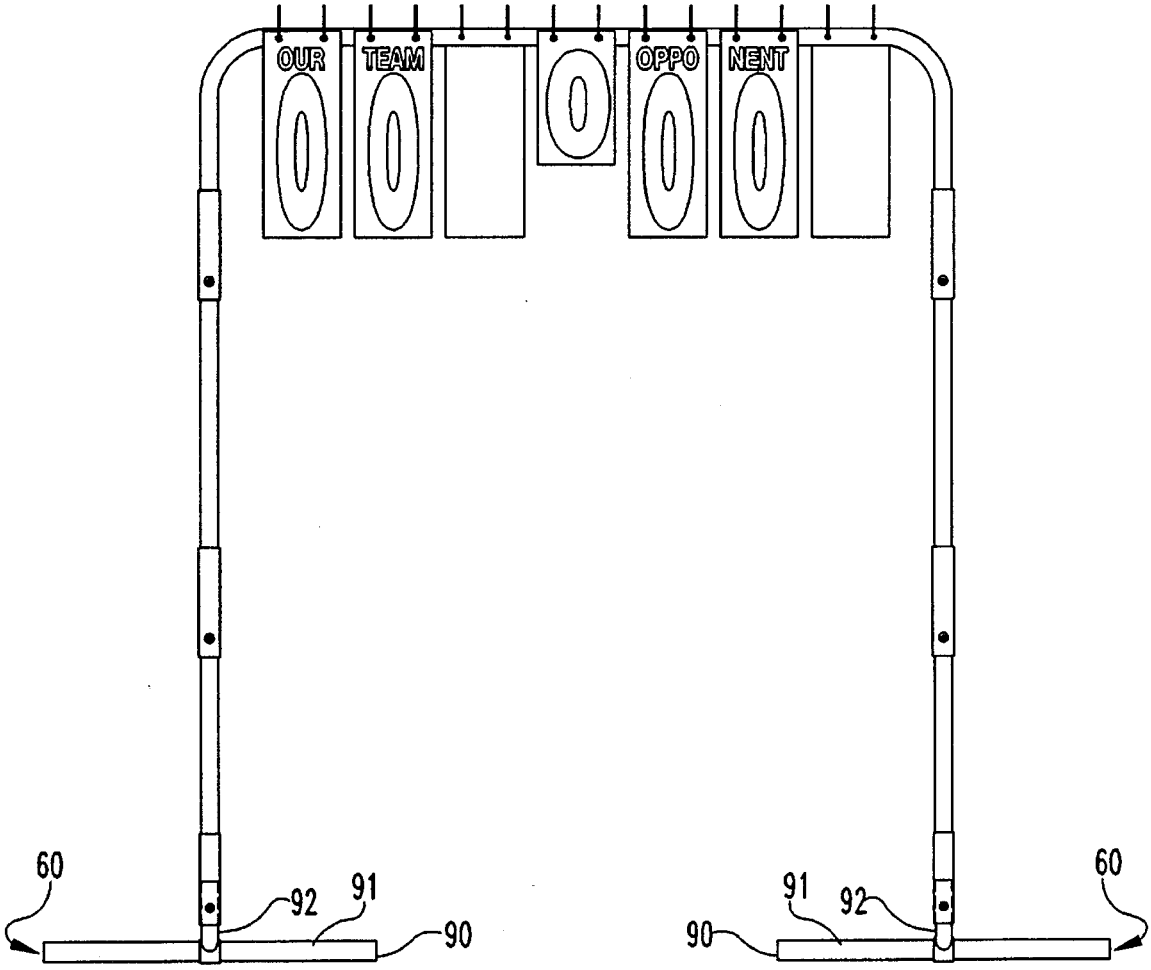

FIG. 7 is a front elevational view of another portable scoreboard according to the present invention.

Figure 8:
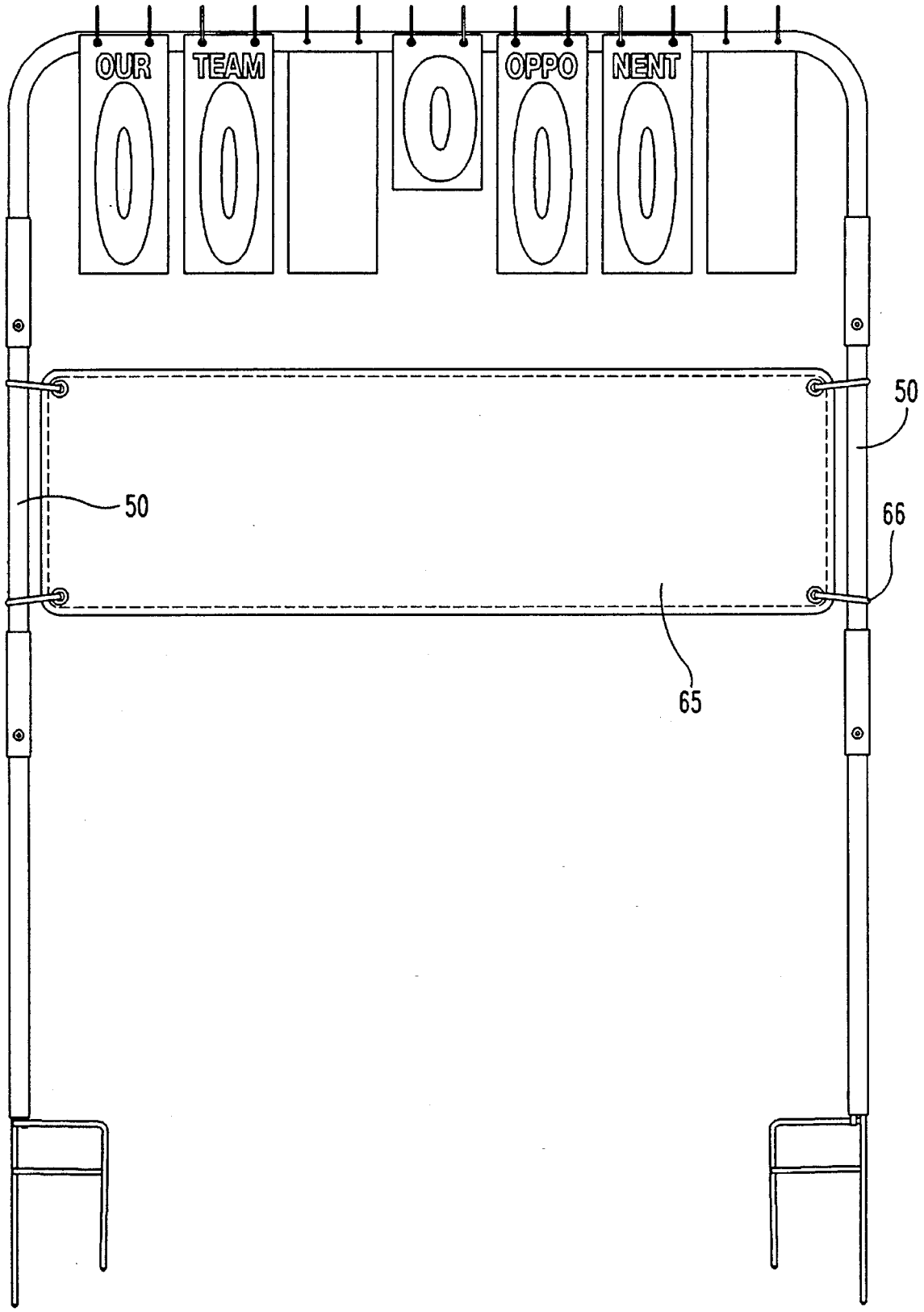

FIG. 8 is a front elevational view of a portable scoreboard according to another specific embodiment of the present invention.

Figure 9:
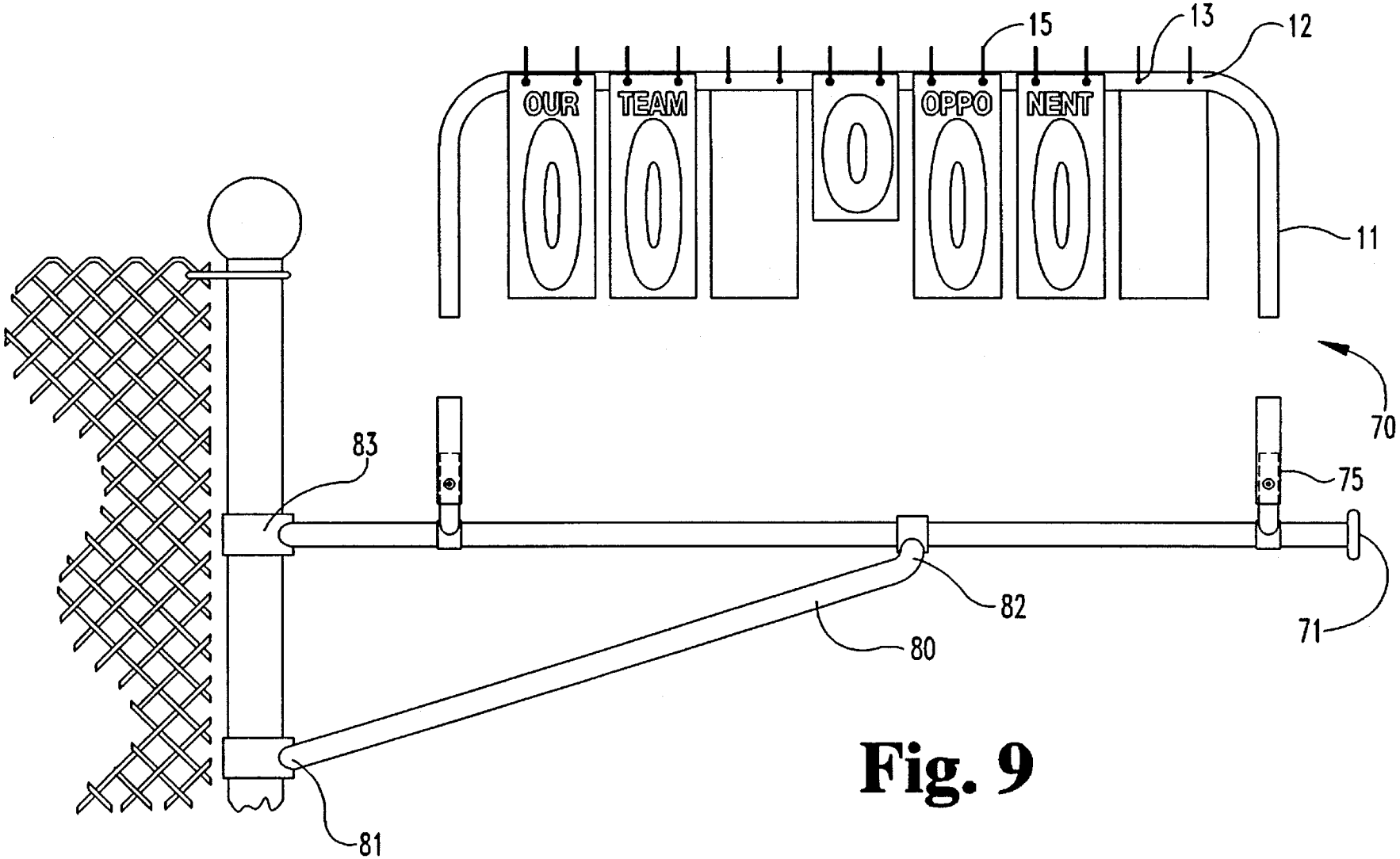

FIG. 9 is a front elevational view of a fence post mountable portable scoreboard according to the present invention.

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

The present invention is useful for scoring sporting and other recreational events. This invention provides a scoreboard which is both portable and highly visible.

Figure 1:
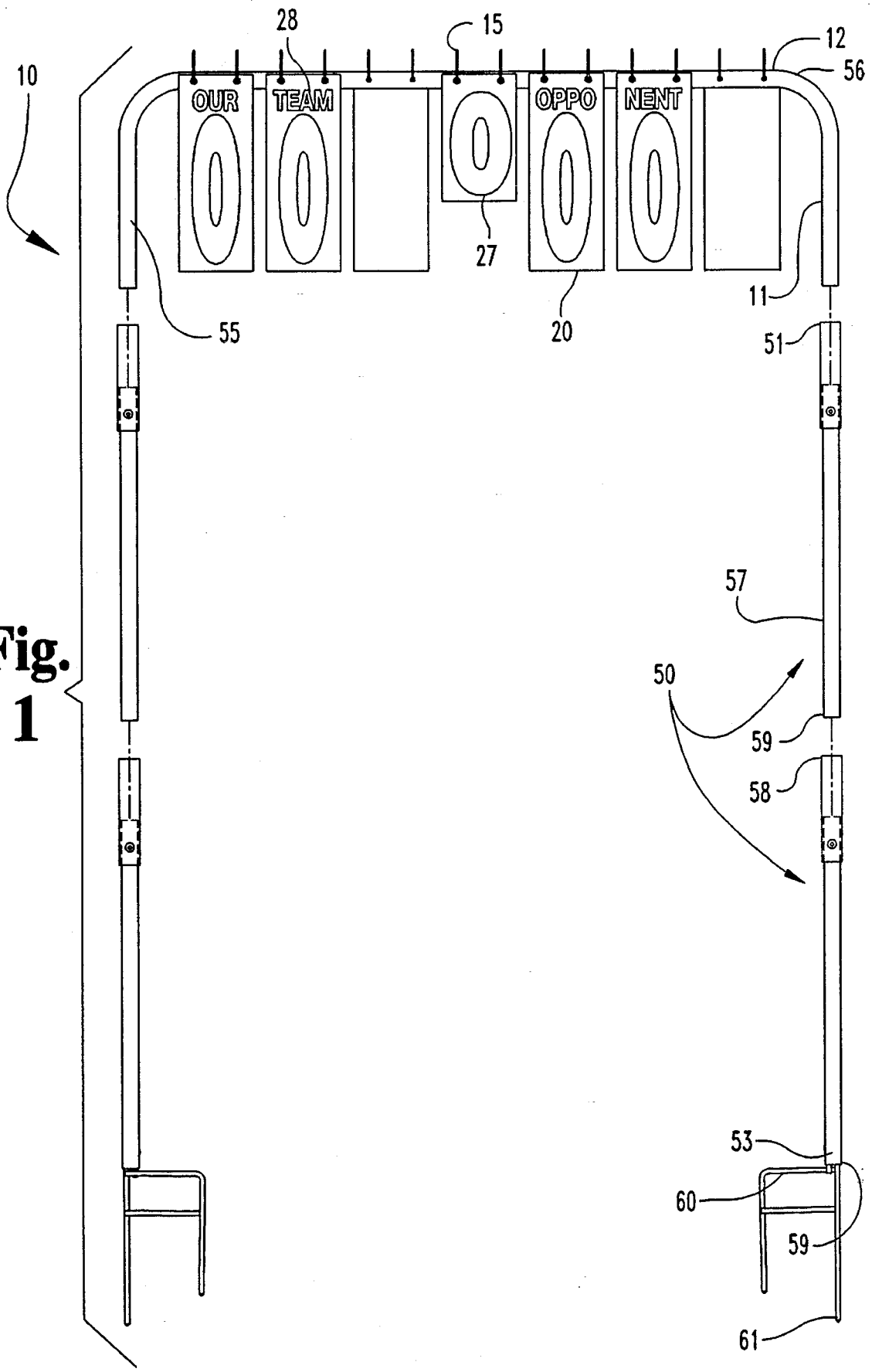
FIG. 1 is an exploded view of a portable scoreboard of the present invention.

A portable scoreboard 10 in accordance with a preferred embodiment of the present invention is depicted in FIG. 1. The scoreboard 10 includes a mounting frame 11 having a horizontal portion 12. A plurality of ring members 15 are engaged to the mounting frame 11. The ring members 15 are aligned in space relation along a length of the horizontal member 12 of the mounting frame 11. A plurality of cards 20 having indicia 28 are suspended from the ring members 15. The cards 20 are arranged in at least two stacks 21 (FIG. 2) and have at least one fastening apertures 22 adjacent to a first end 23 of the card 20. A ring member 15 is positioned through each of the fastening apertures 22. The cards 20 hang from the ring member 15 so that the cards 20 may be rotated around the horizontal portion 12 of the mounting frame 11 to permit alternate display of the indicia 28 on the cards 20. Each stack of cards 21 is aligned in spaced relation along the horizontal portion 12 of the mounting frame 11.

The scoreboard includes at least one leg member 50, having a first end 51 detachably attached to the mounting frame 11. The mounting frame 11 and leg member 50 may be composed of any suitable material in any suitable configuration. The mounting frame 11 and leg member 50 may be composed of metal, plastic, aluminum, wood or composite. It is contemplated that the mounting frame 11 and leg member 50 may be configured from square or round tubing.

Figure 3A:
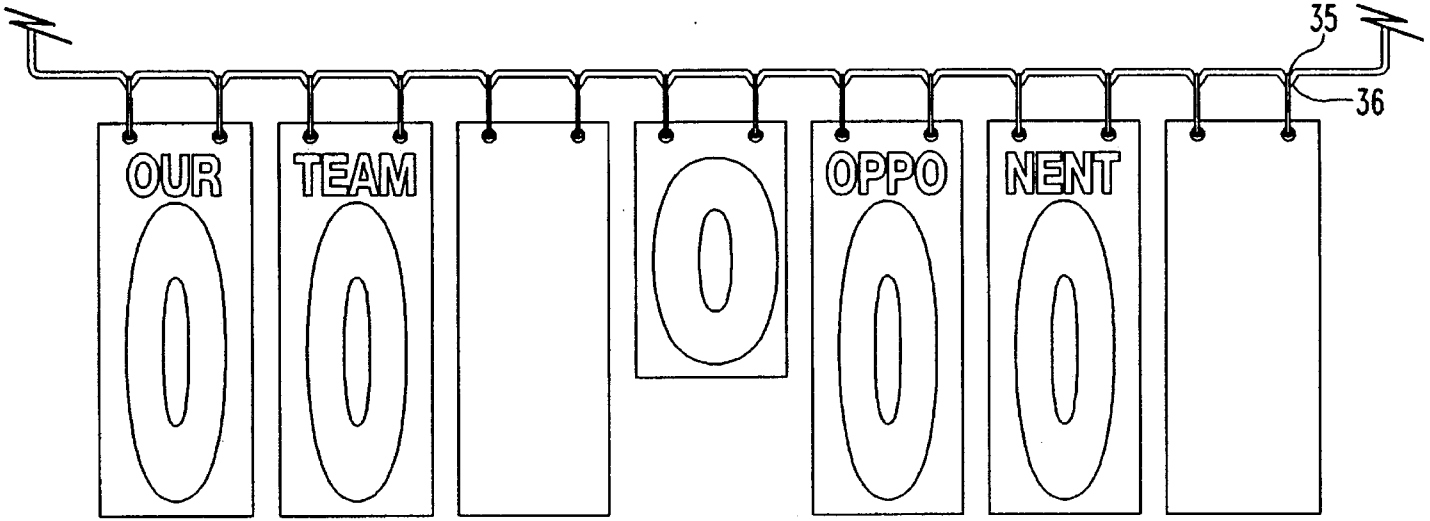
FIG. 3(A) is a front elevational view of the mounting frame, ring members and cards according to one embodiment.
Figure 3B:
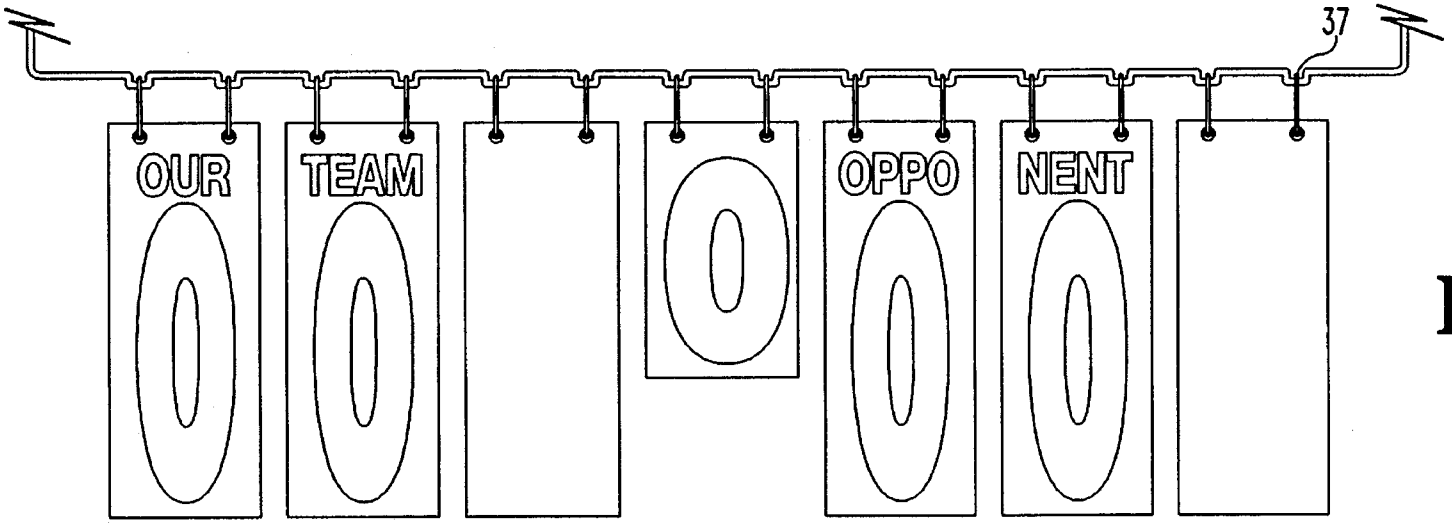
FIG. 3(B) is a front elevational view of the mounting frame, ring members and cards according to one embodiment.
Figure 4:
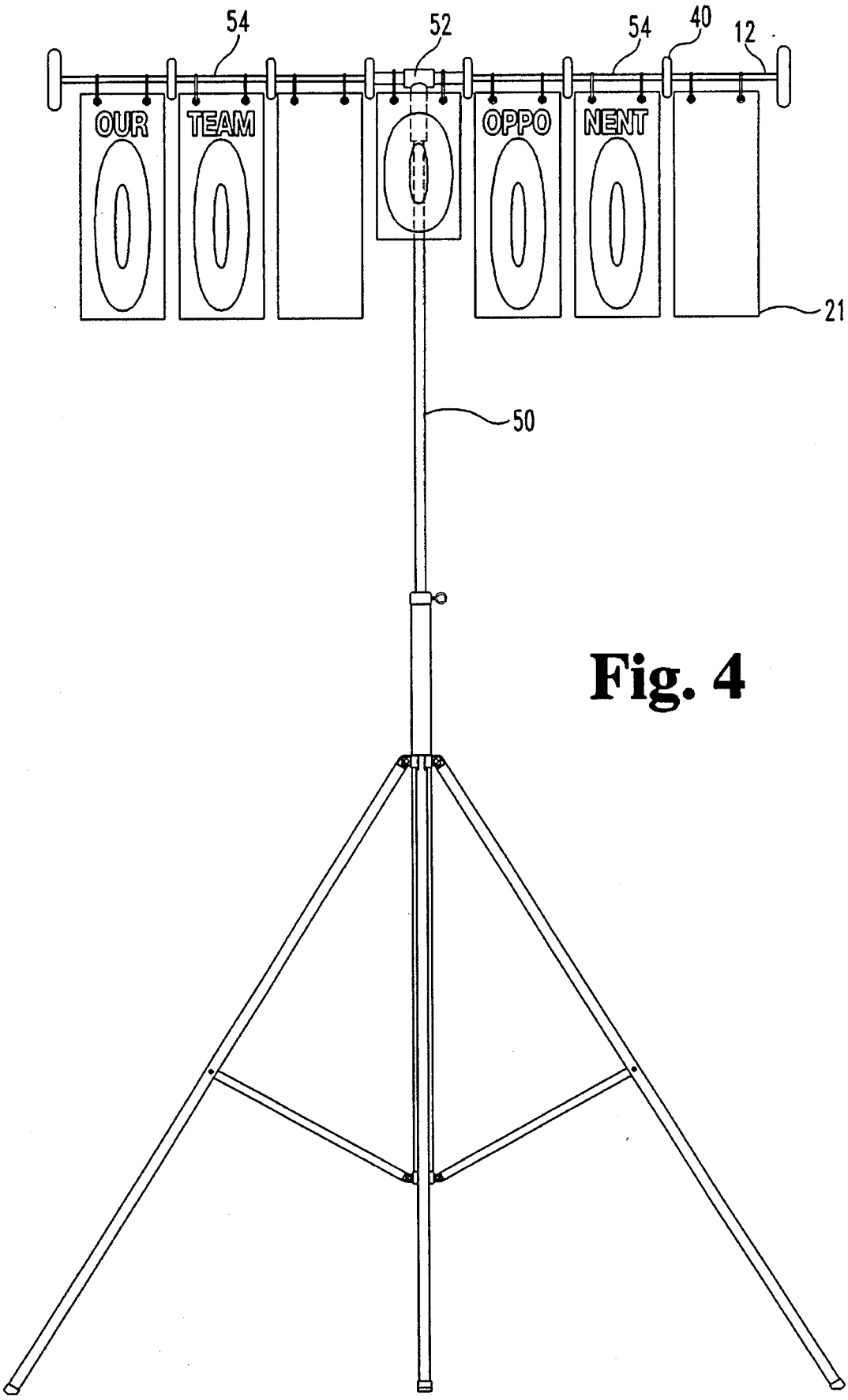
FIG. 4 is a front elevational view of a portable scoreboard according to one specific embodiment of the present invention.

In a preferred embodiment, the horizontal portion 12 of the mounting frame 11 defines a plurality of holes 13. A ring member 15 is threaded through each of the holes 13. This prevents lateral movement of the ring members 15 along the length of the horizontal portion 12 of the mounting frame 11. Alternatively, the mounting frame 11 may be provided with a series of recesses 35 for engagement with a ring member 15 as shown in FIGS. 3(A and B). The recesses 35 may be V-shaped 36 or U-shaped 37, for example. Alternatively, as shown in FIG. 4, the scoreboard 10 may be provided with a pair of stop members 40 for each of the stack of cards 21. The stop members 40 may be press fit onto the horizontal portion 12 of the mounting frame 11. The stop members 40 preferably have an outer diameter larger than a circumference of each of the ring members 15 to restrict lateral movement of the ring members 15.

The ring members 15 may be fixedly attached to a portion of the horizontal member 12 of the mounting frame 11 to prevent free rotation of the ring member 15 around the horizontal portion 12. For example, a ring member 15 may be attached to an internal affixing surface 14 which is created when a hole 13 is drilled into the horizontal portion 12 as shown in FIG. 5.

Figure 5:
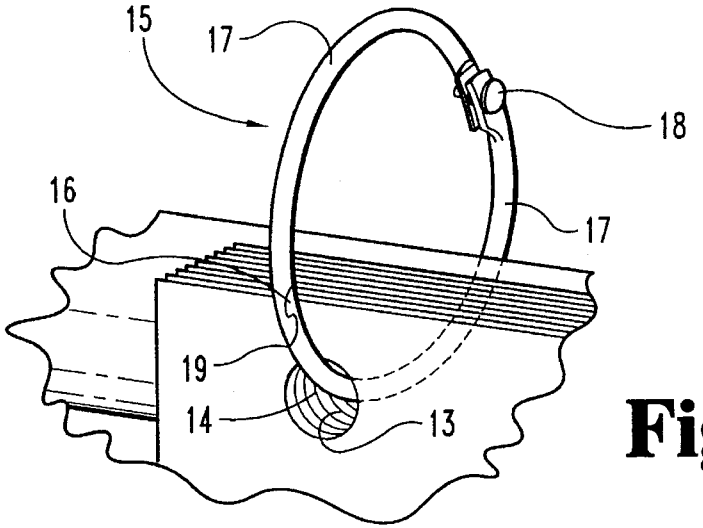
FIG. 5 is a front elevational drawing showing a ring member according to one embodiment.

Referring to FIG. 5, the ring member 15 may be provided with a joint 16 for opening and closing the ring member 15 for removing or adding cards 20. The ring member 15 may be of the conventional type which provides such a joint 16. For example, two half-rings 17 with a pin joint 18 at a first junction and a clasp joint 19 at an opposite junction.

Figure 2:
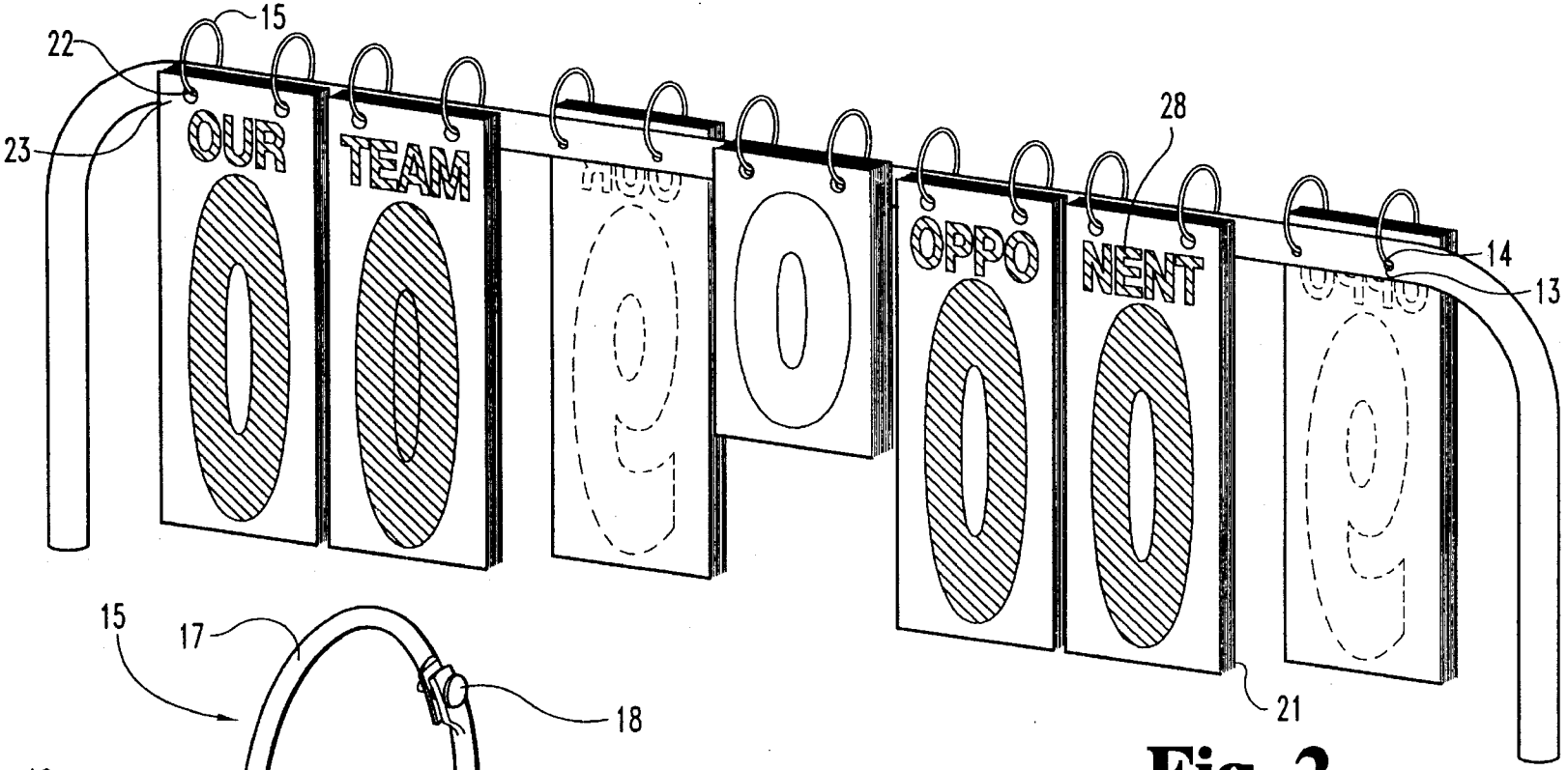
FIG. 2 shows a mounting frame, rings and cards according to one embodiment.

The portable scoreboard 10 of the present invention may include cards 20 which are constructed of plastic, styrene plastic, metal, plain or laminated paper, plain or laminated cardboard or any other suitable material. The cards 20 may be clear or opaque, colored or white. Referring to FIG. 2, the indicia 28 includes lettering 29 and numbers 30 which are sized and shaped to fit on a face of a card 20 and are easily visible from a distance.

Figure 6B:
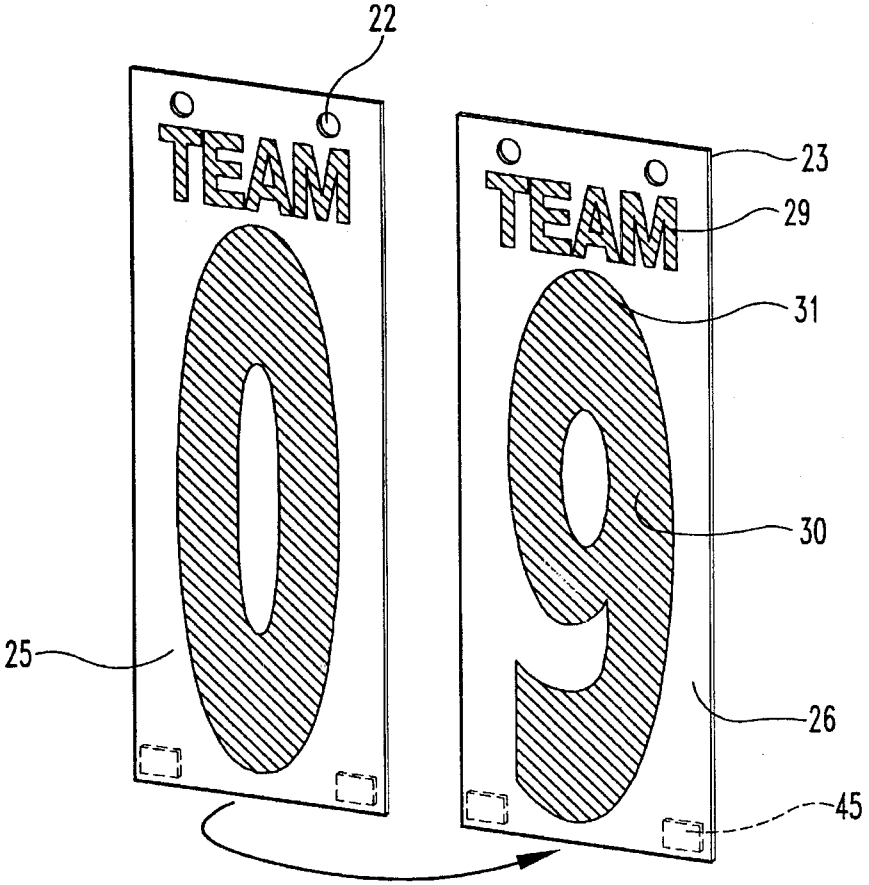

The cards 20 may be one-sided for one side viewing only (FIG. 6A) or may be dual-sided for two-sided viewing (FIG. 6B). In a dual-sided embodiment, each of the cards 20 has a front face 25 and a back face 26. In this embodiment, some of the cards 20 have indicia 28 on both the front face 25 and the back face 26. The numbers 30 on the front face 25 are one number 30 lower in sequence than the number 30 on the corresponding back face 26 of each of the cards 20 so that the same score may be viewed from opposite directions in each stack 21. On both sides of the card 20 the tops 31 of the numbers 30 are adjacent to the fastening aperture 22.

In one specific embodiment of this invention, the cards 20 are arranged in two sets of three stacks 21.

The cards 20 in two of the stacks 21 have both numbers 30 and lettering 29 on both sides of the cards 20. Four of the stacks 21 have numbers 30 on only one side. The sets of the three stacks 21 may be separated by a stack of cards for denoting a period 27 in a sporting event as shown in FIG. 1. The portable scoreboard may also be provided with a stack of cards for identifying the number of "outs" in baseball or softball games. Table 1 shows the arrangement of the numbering 30 and lettering 29 of cards 20 in each set of stacks 21. This arrangement allows for scorekeeping from one side of the portable scoreboard while showing the identical score on both sides.

TABLE 1

| Numbering and Lettering Scheme for Cards of a Portable Scoreboard | | | | | | |
|---|---|---|---|---|---|---|
| Card 1 | Card 2 | Card 3 | Card 4 | Card 5 | Card 6 | Card 7 |
| (Front Lettering) | | | | | | |
| OPPO | NENT | — | — | OUR | TEAM | — |
| (Front/Back Numbering) | | | | | | |
| 1/— | 0/1 | —/9 | 0/1 | 0/— | 0/1 | —/9 |
| 2/— | 1/2 | —/8 | 1/2 | 1/— | 1/2 | —/8 |
| 3/— | 2/3 | —/7 | 2/3 | 2/— | 2/3 | —/7 |
| 4/— | 3/4 | —/6 | 3/4 | 3/— | 3/4 | —/6 |
| 5/— | 4/5 | —/5 | 4/5 | 4/— | 4/5 | —/5 |
| 6/— | 5/6 | —/4 | 5/6 | 5/— | 5/6 | —/4 |
| 7/— | 6/7 | —/3 | 6/7 | 6/— | 6/7 | —/3 |
| 8/— | 7/8 | —/2 | 7/8 | 7/— | 7/8 | —/2 |
| 9/— | 8/9 | —/1 | 8/9 | 8/— | 8/9 | —/1 |
| 0/— | 9/0 | —/0 | 9/0 | 9/— | 9/0 | —/0 |
| (Back Lettering) | | | | | | |
| — | NENT | OPPO | — | — | TEAM | OUR |

In another specific embodiment, the present invention may further include a securing member 45 (FIGS. 6A and 6B) for each of the cards 20 for securing the cards 20 together in a stack 21 to prevent unwanted movement of the cards 20. The securing member 45 is attached to a second end 24 of each of the cards 20. The securing member 45 may be any suitable device including a magnet engaged to each of the cards 20, a hook and loop fastener disposed between adjacent ones of the cards 20 (i.e. Velcro®), or a weight or clip affixed to each of said cards 20.

The mounting frame 11 may include a horizontal member 12 as shown in FIG. 4 with attachment to the leg member 50 at a center point 52. The center point 52 may serve also as an attachment for two separate pieces 54 of the horizontal portion 12. That is, the horizontal portion 12 may include two separate pieces 54 which are joined together at the center point 52. In a preferred embodiment as shown in FIG.

1, the mounting frame 11 includes a horizontal portion 12 and a vertical portion 55 extending downwardly from each of opposite ends 56 of the horizontal member 12. The mounting frame 11 may be composed of a single longitudinal member which is shaped into an inverted-U-shape.

In a most preferred embodiment, an outer diameter of each of the vertical portions 55 of the mounting frame 11 is slightly smaller than an inner diameter of the first end 51 of each of the leg members 50 for detachable attachment of the mounting frame 11 to the leg member 50.

Each leg member 50 may be composed of two or more pieces 57 as shown in FIG. 1. This provides for convenient break down, reassemble and transport of the portable scoreboard. Each piece 57 of the leg member 50 is provided with a first end 58 and a second end 59. Each piece 57 of the leg member 50 is detachably attachable to form the single leg member 50. In a preferred embodiment a first end 58 of each piece 57 of the leg member 50 has an inner diameter which is slightly larger than an outer diameter of the second end 59 of a leg piece 57 to be attached to the first leg piece 57.

The scoreboard 10 also includes a support member 60 attached to the second end 53 of each leg member 50. The support member 60 may be of any shape or configuration which is suitable for supporting the scoreboard 10 securely on an interior surface or attaching to an exterior surface. In one embodiment, the support member 60 has an end 61 configured to be driven into the ground. The support member 60 may be a spike or an h-shaped member as shown in FIG. 1. The support member 60 may be permanently or detachably attached to the second end 53 of a leg member 50. For permanent attachment, the support member 60 may be attached to the leg member 50 by means well known in the art, such as welding, friction fit, rivets or threaded fasteners. In another embodiment, the support member includes a tubular, inverted-T member 90 for in-door use as shown in FIG. 7. The inverted-T member 90 includes a horizontal portion 91 for supporting the scoreboard on a floor surface indoors and a vertical portion 92 for detachable attachment to the second end 53 of the leg member 50. Preferably, the vertical portion 50 has an inner diameter which is slightly larger than an outer diameter of the second end 59 of the leg member 57.

In another preferred embodiment, a banner 65 may be attached to and stretched between each of the leg members 50 as shown in FIG. 8. The banner 65 may include indicia indicating a team name or an advertising slogan. Most preferably, the banner 65 is permanently attached to the leg members 50. The banner 65 may be attached to the leg members 50 with any suitable attaching means 66 as is well known in the art. Suitable attaching means 66 include rings, coil springs, and S-hooks. The rings may be similar to the ring members 15 shown in FIG. 5 in that they have a moveable joint 16 which provides for detachably attaching the banner 65 to the leg members 50. Preferably, the ring does not have a moveable joint so that the banner 65 is permanently attached to the leg members 50. Permanent attachment is preferable when the banner 65 includes advertising indicia.

Another preferred embodiment of the present invention provides a post-mountable portable scoreboard for sporting events. The scoreboard is conveniently mountable on a post of a fence or backstop. The mounting frame 12 of the fence post-mountable scoreboard may be configured as described above. The fence post-mountable portable scoreboard 70 preferably includes an inverted-U-shaped mounting frame 11 having a horizontal portion 12 as shown in FIG. 9, a horizontal support member 71, and a pair of vertical upright leg members 75 and a plurality of cards suspended from the horizontal portion 12 by ring members 15 as described for previous embodiments. Preferably, the horizontal portion 12 of the mounting frame 11 defines a plurality of holes 13 and each of the ring members 15 are threaded through one of the holes 13.

The post-mountable portable scoreboard 70 may include a brace member 80 having a first end 81 attachable to a fence post and a second end 82 attached to the horizontal support member 70. The brace member 80 may be detachably or permanently attached to a fence or backstop post. The post-mountable portable scoreboard 70 is attachable to a post by attaching means 83 which are well known in the art and may include clamps and other suitable devices.

While the invention has been illustrated and described in detail in the drawings and foregoing description, the same is to be considered as illustrating and not restrictive in character, but being understood that only the preferred embodiments have been shown and described and that all changes and modifications that come within the scope of the invention are desired to be protected.

What is claimed is:

1. A portable scoreboard for sporting events, comprising:

an inverted-U-shaped mounting frame having a horizontal member and a vertical portion extending downwardly from each of opposite ends of said horizontal member;

a pair of leg members, each of said leg members having a first end and a second end, the first end of each said leg member detachably attachable to one of said vertical portions of said mounting frame;

a plurality of cards having indicia and arranged in at least three stacks, said stacks aligned in spaced relation along the length of said mounting frame, each of said cards defining at least one fastening aperture there through, said aperture adjacent to a first end of each of said cards, each of said cards having a front face and a back face, wherein said cards in a first stack have the numbers 0 (zero) through 9 (nine) sequentially on both faces, the numbers of the front face being one number lower in sequence than the number on the corresponding back face of each said card in said first stack, and said cards in a second stack have the numbers 0 (zero) through 9 (nine) sequentially on the front face only, and further said cards in a third stack have the numbers 0 (zero) through 9 (nine) sequentially on the back face only, said three stacks of cards being arranged to indicate a score so that the same score may be viewed from opposite sides of said three stacks; and a ring member threaded through each of said fastening apertures in said cards, said ring members engaged to said mounting frame, whereby said cards hang from said rings so that said cards may be rotated around said mounting frame to permit alternate display of said indicia on said cards.

2. The portable scoreboard of claim 1 wherein each of said ring members is provided with a joint for opening and closing the ring member for removing or adding cards.

3. The portable scoreboard of claim 1 wherein said leg members include at least two pieces.

4. The portable scoreboard of claim 1 wherein an outer diameter of each of the vertical portions of said mounting frame is slightly smaller than an inner diameter of the first end of each of said leg members.

5. The portable scoreboard of claim 1 wherein said horizontal member defines a plurality of holes, and wherein one of said ring members is threaded through each of said holes.

6. The portable scoreboard of claim 1 wherein each of said ring members is fixedly attached to a portion of said horizontal portion to prevent free rotation of said ring member.

7. The portable scoreboard of claim 1 wherein the cards are arranged in seven sets having the following indicia scheme:

| Card 1 | Card 2 | Card 3 | Card 4 | Card 5 | Card 6 | Card 7 |
|---|---|---|---|---|---|---|
| | | (Front Lettering) | | | | |
| OPPO | NENT | — | — | OUR | TEAM | — |
| | | (Front/Back Numbering) | | | | |
| 1/— | 0/1 | —/9 | 0/1 | 0/— | 0/1 | —/9 |
| 2/— | 1/2 | —/8 | 1/2 | 1/— | 1/2 | —/8 |
| 3/— | 2/3 | —/7 | 2/3 | 2/— | 2/3 | —/7 |
| 4/— | 3/4 | —/6 | 3/4 | 3/— | 3/4 | —/6 |
| 5/— | 4/5 | —/5 | 4/5 | 4/— | 4/5 | —/5 |
| 6/— | 5/6 | —/4 | 5/6 | 5/— | 5/6 | —/4 |
| 7/— | 6/7 | —/3 | 6/7 | 6/— | 6/7 | —/3 |
| 8/— | 7/8 | —/2 | 7/8 | 7/— | 7/8 | —/2 |
| 9/— | 8/9 | —/1 | 8/9 | 8/— | 8/9 | —/1 |
| 0/— | 9/0 | —/0 | 9/0 | 9/— | 9/0 | —/0 |
| | | (Back Lettering) | | | | |
| — | NENT | OPPO | — | — | TEAM | OUR |

8. A portable scoreboard for sporting events, comprising:

an inverted-U-shaped mounting frame having a horizontal member and a vertical portion extending downwardly from each of opposite ends of said horizontal member;

a pair of leg members, each of said leg members having a first end and a second end, the first end of each said leg member detachably attachably to one of said vertical portions of said mounting frame;

a plurality of cards having indicia and arranged in at least two stacks, said stacks aligned in spaced relation along the length of said mounting frame, each of said cards defining at least one fastening aperture there through, said aperture adjacent to a first end of each of said cards, each of said cards having a front face and a back face, a number of said cards having numbers on both faces, the numbers of the front face being one number lower in sequence than the number on the corresponding back face of each said card so that the same score may be viewed from opposite directions in each said stack;

a ring member threaded through each of said fastening apertures in said cards, said ring members engaged to said mounting frame, whereby said cards hang from said rings so that said cards may be rotated around said mounting frame to permit alternate display of said indicia on said cards;

a securing means for securing said cards together to prevent unwanted movement of said cards, said securing means attached to a second end of each of said cards.

9. The portable scoreboard of claim 8 wherein said securing means includes a magnet engaged to each of said cards.

10. The portable scoreboard of claim 8 wherein said securing means includes a hook and loop fastener disposed between adjacent ones of said cards.

11. The portable scoreboard of claim 8 wherein said securing means includes a weight affixed to each of said cards.

12. A post-mountable, portable scoreboard for sporting events, comprising:

an inverted-U-shaped mounting frame having a horizontal portion and a vertical portion extending downwardly from each of opposite ends of said horizontal portion;

a horizontal support member attachable to a post;

a pair of vertical upright leg members, each of said leg members having a first end detachably attachable to a vertical portion of said mounting frame and a second end attached to said horizontal support member;

a plurality of cards having indicia and arranged in at least two stacks, said stacks aligned in spaced relation along the length of said mounting frame, each of said cards defining at least one fastening aperture there through;

a ring member threaded through each of said fastening apertures in said cards, said ring members engaged to said mounting frame, whereby said cards hang from said rings so that said cards may be rotated around said mounting frame to permit alternate display of said indicia of said cards; and a securing means for securing said cards together to prevent unwanted movement of said cards, said securing means attached to a second end of each of said cards.

13. The portable scoreboard of claim 12 wherein said securing means includes a magnet engaged to each of said cards.

14. The portable scoreboard of claim 12 wherein said securing means includes a hook and loop fastener disposed between adjacent ones of said cards.

15. The portable scoreboard of claim 12 wherein said securing means includes a weight affixed to each of said cards.

* * * * *